United States Patent [19]

Hendry et al.

[11] Patent Number: 4,824,374

[45] Date of Patent: Apr. 25, 1989

[54] TARGET TRAINER

[76] Inventors: Dennis J. Hendry; Peter J. King, both of c/o Fitzalan Road, Arundel, West Sussex BN18 9JS, England

[21] Appl. No.: 892,864

[22] Filed: Aug. 4, 1986

[51] Int. Cl.[4] ..... F41J 5/08

[52] U.S. Cl. ..... 434/22; 434/21

[58] Field of Search ..... 434/21, 22

[56] References Cited

U.S. PATENT DOCUMENTS 3,889,396 6/1975 Aronson ..... 434/21

4,019,262 4/1977 Breglia et al. ..... 434/21

4,336,018 6/1982 Marshall et al. ..... 434/22

4,538,991 9/1985 Simpson et al. ..... 434/21

*Primary Examiner*—Leo P. Picard

*Attorney, Agent, or Firm*—Wenderoth, Lind & Ponack

[57] ABSTRACT

A target trainer has a screen on which is depicted a scene, a target projector for projecting the image of a moving target on the screen, and a combination of an infra-red target beam projector and infra-red sensitive television camera, associated with a simulated weapon and the target to determine the accuracy of simulated shooting at the target.

9 Claims, 2 Drawing Sheets

TARGET TRAINER

Figure 1:
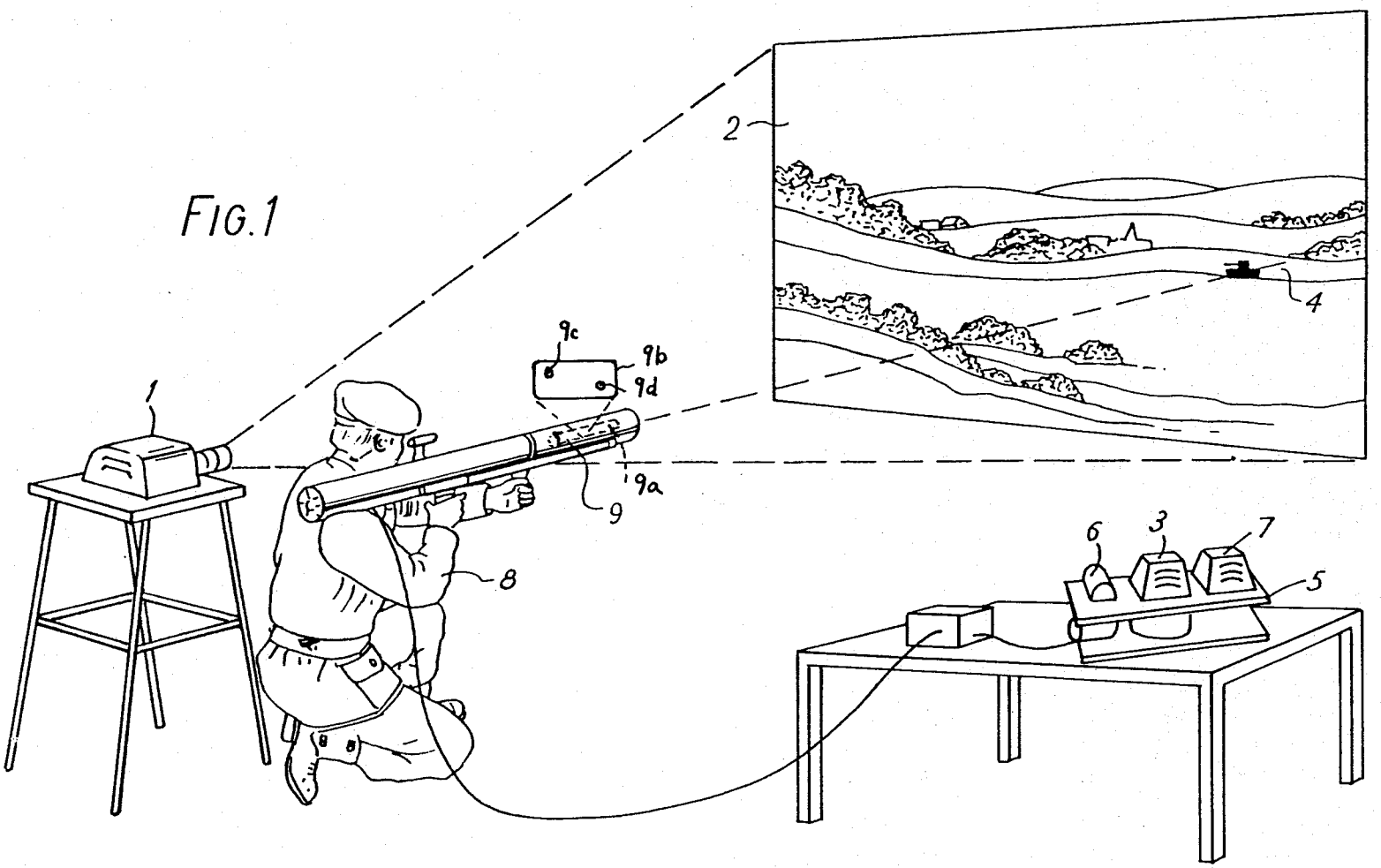

The invention relates to a target device for simulating a target moving over a suitable terrain with means for responding to a simulated weapon fired at the target. The present invention is a development of the invention described and claimed in British Pat. No. 2063432, hereinafter referred to as the "earlier patent".

The earlier patent describes and claims a target device which comprises a screen; a projector for projecting onto the screen a picture of a terrain; a reflective target board bearing a non-reflective silhouette of a target; a light sensor arrangement on the target board; and drive means for driving the target board over the screen in a desired direction.

By directing a scene (either still or moving) onto the screen and onto the target board, the target board can be substantially invisible and give the impression of a realistic target moving over the terrain. In the earlier patent the target comprised a silhouette which was of fixed shape and size and shutter arrangements were described for giving an appearance of changing aspect and size of the silhouette, so as to give the impression of a target which turned and which changed in apparent size with range.

Means were provided in the earlier patent for giving a visual "fall of shot" indication to show where the simulated shot would have fallen in relation to the target. This comprised a set of light-emitters on the target board which were energised selectively in accordance with the calculated shot trajectory.

Another prior target trainer is described in U.S. Pat. No. 4290757. In this arrangement a visual scene projector projects an image of terrain over which a target image, projected by a target projector moves. Movement of the target image is imparted by a positioning serve system which moves a reflector positioned to reflect the target image onto the screen. Fall of shot indication is given by a laser which projects light onto the screen via the said reflector, the position servo system being activated in accordance with the calculated position of the shot.

Both of the above-described arrangements suffer from the disadvantage that the fall of shot indicator is associated with the target positioning system. In the arrangement described in the earlier British patent it is not possible for indication of fall of shot to be given beyond the limits of the target board. In the arrangement described in the U.S. patent it is not possible to give a simultaneous display of the fall of shot and the target unless they are coincident.

One object of the present invention is to provide a target trainer which allows a more flexible fall-of-shot indication. Another object of the invention is to provide a more realistic display of a target image when projected onto a screen which bears a projected terrain scene.

According to one aspect of the invention there is provided a target trainer comprising a screen for displaying a picture of a terrain; a target projector for projecting on to the screen a target image; drive means for moving the target image across the screen; a shot simulator/detector arrangement comprising (a) a target beam projector for projecting on to the target a spot of infra-red light; (b) a television camera directed at the region of the target and responsive to the infra-red spot; and (c) means for analysing the position of the infra-red spot in the camera field of view to give an output signal representative of the position of the fall shot; and a fall-of-shot indicator comprising a further projector for projecting a shot indicator beam of light on to the screen and positioning means responsive to the output signal to position the shot indicator beam on the screen independently of the target.

According to another aspect of the invention there is provided a target trainer comprising a screen for displaying a picture of a terrain; a target projector for projecting on to the screen a target image; drive means for moving the target image across the screen; a shot simulator/detector arrangement comprising (a) a target beam projector for projecting on to the target a spot of infra-red light; (b) a television camera directed at the region of the target and responsive to the infra-red spot; and (c) means for analysing the position of the infra-red spot in the camera field of view to give an output signal representative of the position of the fall shot, the target projector comprising a photographic slide which has a required dark silhouette outlined by an optical field bright at the centre and progressively darkening towards the edges.

According to another aspect of the invention there is provided a target trainer comprising a screen for displaying a picture of a terrain; a target projector for projecting on to the screen a target image; drive means for moving the target image across the screen; a shot simulator/detector arrangement comprising (a) a target beam projector for projecting on to the target a spot of infra-red light; (b) a television camera directed at the region of the target and responsive to the infra-red spot; and (c) means for analysing the position of the infra-red spot in the camera field of view to give an output signal representative of the position of the fall shot, there being further provided a television display driven by the television camera and displaying a representation of the aiming graticule of the weapon indicating the current point of aim and a marker displayed by computation to be the correct point of aim.

In a preferred form of the apparatus the beam projector is mounted on the target image projector so that the infra-red spot is always at the center of the target, and the camera is mounted in a simulated weapon. Thus, when the weapon trigger is squeezed, the camera will receive an image of the infra-red spot at a position in its field of view which is related to the direction of the shot.

However, the arrangement may be reversed so that the camera is mounted on the target image projector to track the target and the target beam projector is mounted on the weapon. If there is more than one weapon in use at a time, this arrangement will require modulation of the infra-red beam so that the camera can distinguish between different weapons. However, it has the advantage that only one camera is required.

Figure 2:
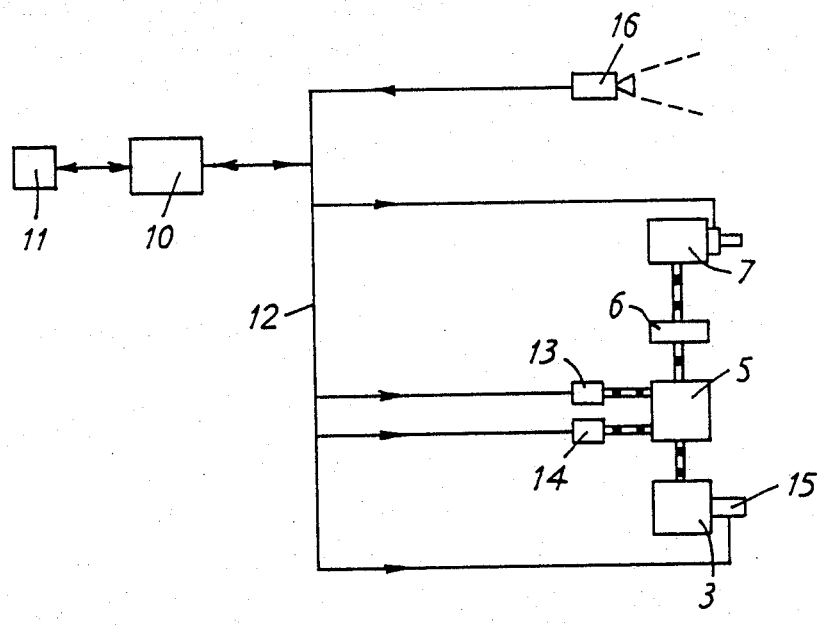

The invention will further be described with reference to the accompanying drawings, of which FIG. 1 is a perspective view of a target trainer in accordance with the invention; and FIG. 2 is a block diagram of the circuitry of the trainer of FIG. 1.

Referring to FIG. 1 there is shown a projector 1 which projects a scene carried on a photographic slide onto a white screen 2 at a distance of typically 4 to 5 meters. However, this distance could be much greater. The scene is of a countryside terrain.

A second projector 3 produces a target image 4 on the screen. The image is a dark silhouette of, in this example, a tank. It is found that a satisfactory image can be produced from a specially prepared slide which has the silhouette outlined by an optical field bright at the centre and progressively darkening towards the edges. In this way the target surround merges with the background. Alternatively, a luminous target may be used, the slide in this case being such as to throw a patch of light on to the screen to represent the target, instead of a shadow.

The target image projector 3 is mounted on a carriage 5 which is motor-driven so that the image traverses the screen in a predetermined manner. Another motor is controlled to adjust a zoom lens on projector 3 so as to cause the target image to change size to indicate changing range.

Two further projectors are mounted on carriage 5. Firstly, there is a target beam projector 6 which directs an infra-red beam to produce a spot at the centre of the target. Secondly, there is a fall of shot projector 7 which has a movable shutter controlled to produce a spot of visible light in the target area at a position representative of the fall of shot, in a manner to be described.

The trainer is shown at 8 and has a simulated weapon 9 which he directs at the moving target. The weapon 9 carries a miniature television camera **9*a* which is filtered to respond only to infra-red light. When the trainer squeezes the trigger of the weapon the camera produces a video signal output which represents the position of the infra-red spot in the field of view of the camera, and therefore represents the accuracy of the shot. The television camera 9*a* can produce a television display 9*b* displaying a representation 9*c* of the aiming graticule of the weapon indicating the current point of aim and a marker 9*d*** displayed by computation to be the correct point of aim.

The video signal is processed and a fall-of-shot signal is produced which controls projector 7 to produce a visible spot of light on the screen representative of the position of the shot.

FIG. 2 shows the control circuitry of the system. A micro-processor 10 has reference to balistics data stored in a ROM 11. Under control of a program, the microprocessor produces signals on a data bus 12 to horizontal and vertical drive motors 13 and 14 which drive the carriage 5. Signals are also provided to a zoom lens motor 15 of projector 3.

Video signals from the camera, shown at 16, are processed and provide the control signals for the fall-of-shot projector 7, which is mounted on carriage 5, along with the infra-red beam projector 6.

The invention is not restricted to the details of the embodiment described above. For example, the infra-red target beam spot can be derived from the target image projector itself, so eliminating the need for an additional and separately collimated infra-red projector. This is particularly easy if a quartz/Halogen or similar projector light bulb rich in infra-red content is employed for target image projection. The effect can be achieved by the use of a filter which blocks infra-red light being incorporated in the slide material or being mounted against the slide. A small hole in this filter material at the center of the target allows an infra-red spot to fall at the appropriate position on the screen. If the target is a dark silhouette, it must be ensured that is center does not block infra-red light. If necessary, the center of the target should be constituted by a clear area covered by a filter which passes only infra-red light.

We claim:

1. A target trainer comprising a screen for displaying a picture of a terrain; a target projector means for projecting onto the screen a target image; drive means coupled with said target projector for moving the target image across the screen; a shot simulator/detector arrangement having (a) a target beam projector means for projecting onto the target a spot of infra-red light, (b) a television camera directed at the region of the target and responsive to the infra-red spot, and (c) means connected to said television camera for analyzing the position of the infra-red spot in the camera field of view to give an output signal representative of the position of the fall-of-shot, and a fall-of-shot indicator having a further projector means for projecting a fall-of-shot indicator beam of light onto the screen and including positioning means responsive to the output signal to position the fall-of-shot indicator beam on the screen independent of the target.

2. A target trainer as claimed in claim 1 wherein the positioning means is a movable shutter.

3. A target trainer as claimed in claim 1 further comprising mounting means on which the further projector means and the target projector means are mounted and to which said drive means is connected for driving said target projector means and said further projector means together.

4. A target trainer as claimed in claim 1 wherein the target beam projection means is mounted on the target image projector means, and further comprising a simulated weapon in which said camera is mounted.

5. A target trainer as claimed in claim 1 wherein the camera is mounted on the target image projector means and a simulated weapon in which said target beam projector means is mounted.

6. A target trainer as claimed in claim 1 wherein the target projector means comprises a photographic slide which has a required dark silhouette outlined by an optical field bright at the centre and progressively darkening towards the edges.

7. A target trainer as claimed in claim 1 wherein the target beam projector means and the target projector means are constituted by a single projector having means for deriving an infra-red target beam by filtering, from the illumination source for the target.

8. A target trainer comprising: a screen for displaying a picture of a terrain; a target projector for projecting onto the screen a target image; drive means coupled with said target projector for moving the target image across the screen; a shot simulator/detector arrangement having (a) a target beam projector for projecting onto the target a spot of infra-red light, (b) a television camera directed at the region of the target and responsive to the infra-red spot, and (c) means for analyzing the position of the infra-red spot in the camera field of view to give an output signal representative of the position of the fall of shot, the target projector being comprised of a photographic slide which has a required dark silhouette outlined by an optical field bright at the center and progressively darkening towards the edges.

9. A target trainer comprising: a screen for displaying a picture of a terrain; a target projector for projecting onto the screen a target image; driving means coupled with said target projector for moving the target image across the screen; a shot simulator/detector arrangement having (a) a target beam projector for projecting onto the target a spot of infra-red light, (b) a television camera directed at the region of the target and responsive to the infra-red spot, and (c) means for analyzing the position of the infra-red spot in the camera field of view to give an output signal representative of the position of the fall of shot; a television display driven by the television camera and displaying a representation of the aiming graticule of the weapon indicating the current point of aim and a marker displayed by computation to be the correct point of aim.

* * * * *